US005196074A

United States Patent [19]

Welter et al.

[11] Patent Number: 5,196,074

[45] Date of Patent: Mar. 23, 1993

[54] COPPER ALLOYS CAPABLE OF SPINODAL DECOMPOSITION AND A METHOD OF OBTAINING SUCH ALLOYS

[75] Inventors: Jean-Marie Welter, Gisors; Pierre Naudot, Maisons Laffitte, both of France

[73] Assignee: Trefimetaux, Courbevoie, France

[21] Appl. No.: 696,127

[22] Filed: May 6, 1991

[30] Foreign Application Priority Data

May 11, 1990 [FR] France ..... 90 06489

[51] Int. Cl.[5] ..... B22F 1/00

[52] U.S. Cl. ..... 148/514; 148/522; 148/536; 148/553; 148/554; 148/679; 148/685

[58] Field of Search ..... 148/513, 514, 522, 536, 148/553, 554, 679, 685, 686

[56] References Cited

U.S. PATENT DOCUMENTS 4,373,970 2/1983 Scorey et al. ..... 148/400

4,525,325 6/1985 Livak ..... 420/473

*Primary Examiner*—John P. Sheehan

*Attorney, Agent, or Firm*—Dennison, Meserole, Pollack & Scheiner

[57] ABSTRACT

A method is disclosed for manufacturing a finished product which consists at least partially of a copper nickel and tin based alloy which has undergone spinodal decomposition. A liquid bath of the Cu Ni Sn based alloy is prepared containing also titanium and possibly lead. A semi-finished product is formed by spray-deposition of this alloy onto a backing then transformed with an annealing stage followed by rapid tempering. The product obtained after transformation of the semi-finished product is subjected to a heat annealing treatment in order to carry out spinodal decomposition of the part of the said product which is constituted by Cu Ni Sn based alloy, to obtain a finished product. A semi-finished product or product is obtained by this method. Connectors and machinable products based on Cu Ni Sn and of high and homogeneous hardness are manufactured.

11 Claims, No Drawings

COPPER ALLOYS CAPABLE OF SPINODAL DECOMPOSITION AND A METHOD OF OBTAINING SUCH ALLOYS

FIELD OF THE INVENTION

The invention relates to the field of alloys of copper, nickel and tin which are capable of spinodal decomposition, and to a method of producing such alloys.

REMINDER OF THE PRIOR ART

These copper alloys in which hardening due to the solid solution is reinforced by spinodal decomposition which may even culminate in hardening by precipitation, have been the subject of much research because it would be advantageous to use them instead of copper-beryllium alloys.

For instance, U.S. Pat. No. 3,937,638 describes Cu Ni Sn alloy compositions and a method of producing them which comprises an homogenisation phase at 800° C., hot and cold shaping with intermediate annealing stages at 800° C. followed by hardening, the final cold forming being followed by annealing at around 300° C.

U.S. Pat. No. 4,052,204 describes Cu Ni Sn alloy compositions which may contain Fe, Zn, Mn, Zr, Nb, Cr, Al, Mg. Furthermore, a Sn and Ni selective composition, according to U.S. Pat. No. 4,090,890, makes it possible to obtain bend-resistant strip.

U.S. Pat. No. 4,260,432 describes a Cu Ni Sn alloy composition containing Mo, Nb, Ta, V and Fe comprising a hot or cold shaping stage, intermediate annealing followed by tempering, cold shaping and a final annealing stage.

The processes described in these American Patents all reflect what has become conventionally referred to as classic metallurgy, that is to say production of a slug by smelting and casting-solidification.

In the case of Cu Ni Sn alloys, the drawback with these methods is inherent in the actual form of the diagram of equilibrium of the three constituents Cu, Ni and Sn which shows a wide solidification span resulting in substantial segregation of the tin which is incompatible with obtaining homogeneous mechanical properties throughout the entire alloy. Long-duration thermal treatments are there described as a way of compensating for the disadvantageous effects of this segregation but, as indicated in European Patent No. 079755, although these treatments are valid on a laboratory basis, their effectiveness has never been demonstrated on an industrial scale.

Furthermore, a method is also known for the continuous casting of bars from a liquid metal bath. In this method, in order to combat segregation of the tin, it is necessary to impose a high rate of solidification with considerable rates of flow of water for cooling the graphite ingot mould, which means that the method is not very economic and is restricted to the manufacture of products of small cross-section; with regard to specific metal additions such as V, Nb, Ta, suggested as a way of limiting the results of segregation of the tin, these are expensive and not very effective.

In contrast, European Patent No. 079755 describes a method of producing an alloy of Cu Ni Sn, which may contain other elements in small quantities such as Fe, Mg, Mn, Mo, Nb, Ta, V, Al, Cr, Si, Zn, Zr and which uses a metallurgical technique involving powders previously obtained by spraying and which comprises a stage in which the powders are compacted to form a strip, as well as stages for sintering, cooling, cold-rolling with intermediate annealing stages followed by tempering, a final annealing followed by a hardening and then a process annealing stage.

On the one hand, the powder metallurgy process described in this European Patent only makes it possible to obtain a finished product which is confined to a thin rolled product such as a strip, ribbon or sheet while on the other it results in alloys of high prime cost on account of the two successive stages of obtaining the powder and compacting it.

Finally, taking all these problems into account, this family of alloys has still not enjoyed a real industrial and commercial success.

OBJECT OF THE INVENTION

The object of the invention is the economic industrial manufacture of finished or semi-finished products based on Cu Ni Sn alloys which are capable of spinodal decomposition and which may comprise other minor elements of addition and which do not exhibit any segregation of the tin; it also has as object a method which makes it possible to manufacture all the products required by the market for this type of alloy of whatever shape or size, combining rapid solidification of the liquid metal and manufacture of the blank (semi-finished product) which is capable of being worked either hot or cold, into one single production stage.

Finally, the invention has as object improved machining properties to the extent of permitting industrial production of parts which it has not been hitherto possible to produce with this type of alloy.

DESCRIPTION OF THE INVENTION

The invention relates to a method of manufacturing a finished product consisting at least partially of a copper, nickel and tin based alloy which has undergone spinodal decomposition, characterised in that:

a) a liquid bath of the Cu Ni Sn based alloy is prepared, containing also titanium or any other decarburising and refining element and possibly lead;

b) a semi-finished product is formed by spray-deposition of this alloy onto a backing which serves as a carrier;

c) this semi-finished product of which a part may be constituted by the said backing can be transformed with, where necessary, a "flash" process annealing followed by rapid tempering;

d) the product obtained after transformation of the semi-finished product is subjected to a heat annealing treatment in order to bring about spinodal decomposition of the part of the product which consists of the Cu Ni Sn based alloy and in order thus to obtain a finished product.

The Cu Ni Sn based alloys according to the invention have the following composition by weight:

| | |
|---|---|
| Ni | from 0.5 to 35% |
| Sn | from 3 to 13% |
| Ti | from 0.005 to 0.5% |
| Pb | up to 0.5% |
| Impurities | up to 0.5% |
| Cu | balance |

Preferably the composition of Ni by weight is between 8 and 16% while that of Sn is between 4 and 10%.

According to the invention, it is particularly advantageous for economic reasons and in order to ensure the Ti content in the alloy, to use recycled metals: niobium-titanium from supraconductive cables, nickel titanium from shape memory alloys, ferro-titanium and manganese-titanium from alloys for storing hydrogen in the form of hydrides.

According to a first stage of the invention, an alloy is prepared in the liquid state, based on Cu Ni Sn with Ti and possibly Pb by smelting in an induction furnace provided with a silicon carbide crucible, of a mixture in the proportions of the nominal composition of the alloy, electrolytic copper containing 99.99% by weight copper, electrolytic nickel containing 99.92% by weight nickel and electrolytic tin containing 99.9% by weight tin and containing very little carbon ($C<0.002\%$), and also titanium, preferably in the form of a recycled metal, on grounds of economy.

Smelting is conducted under a good quality charcoal covering, previously ignited, at up to 1280° or 1300° C. to be sure that all the nickel has melted. Then electrolytic quality tin is introduced by means of a graphite cloche in the proportion corresponding to the nominal composition of the alloy which it is desired to produce. The lead may possibly be added in the same way after which there is a 20 minute wait for the temperature to reach 1100° to 1200° C. Free titanium is measured out into the bath; indeed, the titanium plays its part in the process firstly as an agent for decarburising the nickel so that if the nickel supplied was of a lower quality and therefore had a higher carbon content, a greater quantity of Ti would be converted to insoluble titanium carbide; the titanium also acts as an agent for deoxidising the bath, the titanium oxide likewise being insoluble in the bath. Measured dispensing of the free Ti makes it possible accurately to adjust the composition of the bath in terms of Ti, Ti being introduced in the form of a Cu-Ti mother alloy in order to obtain the nominal Ti content. There is then a 10 minute wait and the alloy is cleansed before casting. The liquid alloy (possibly after filtration) is ready to be converted to a semi-finished product by spray-deposition. It is likewise possible to envisage liquid bath refinement by injection of gas or by passing through a vacuum.

The term spray-deposition is understood as meaning a process in which the molten metal is divided into fine liquid droplets which are then directed at and agglomerated on a backing in such a way as to form a solid and cohesive deposit in which there is a slight closed porosity. This deposit may take the form of billets, plates, slabs, tubes of controlled geometry or blanks of various shapes which are ready for instance to be forged and which we will designate by the general term "semi-finished product".

This deposit may be separated from the backing which serves as a support and in this case the semi-finished product consists solely of Cu Ni Sn based alloy; it is also possible to maintain it attached to the support so that after conversion it is possible to obtain a multi-layer composite material with one part consisting of Cu Ni Sn based alloy while one part consists of a material constituting the said backing. In this case, the material of the said backing is preferably copper, aluminium, stainless steel based.

There are many alternative forms of the spray-deposition method; one technique of this type is designated by the name "spray-deposition" by the Anglo-Saxons; it is described in the following Patent Applications: GB-B-1379261, GB-B-1472939, GB-B-1548616, GB-B-1599392, GB-A-2172827, EP-A-225080, EP-A-225732, WOA-87-03012.

Applied to the alloys of the invention, the spray-deposition process has many interesting aspects:

it avoids segration of the tin since solidification is achieved at droplet level, and therefore in a volume of a few hundredths of a cubic micron and it occurs very rapidly; on the other hand, and in contrast to conventional powder metallurgy, cooling takes place more slowly so permitting of better homogenisation of the alloy. The consequences of this uniform distribution of the tin in the alloy mass are due to the absence of any formation of coarse solidification dendrites; spinodal decomposition and therefore the hardness of the final alloy is favoured by a regular tin distribution;

in the case of the lead alloy, the lead is in solid solution in the liquid copper but is completely insoluble in the solid copper. Thus, with the method according to the invention, the lead places itself out of solution within each droplet with no risk of coalescence between adjacent droplets: thus, there is a very fine dispersion of lead which no other process can provide for this type of alloy and which is the reason for the excellent aptitude for machining which is a feature of the alloy according to the invention. The result therefore is an alloy which is homogeneous in terms of both Sn and Pb without any expensive homogenisation phase. It should be noted that the homogenisation treatment in conventional metallurgy, although it makes it possible partially to reduce tin segregation, does at the same time cause a latent coalescence of the lead. Furthermore, this is the reason why U.S. Pat. No. 4260432 imposes a maximum lead content of 0.005% and ASTM Standard No. B-740-87 limits the lead content in Cu Ni Sn alloys to a level of below 0.02%;

the method results in a semi-finished product of low porosity, with an apparent density of greater than 95% of the theoretical density and which is generally between 99 and 100%. The residual porosity is a closed porosity which has no harmful effect and which in the main will disappear during conversion of the semi-finished product.

According to the invention, the transformation of the semi-finished products uses alone or in combination the known means of working metal such as, according to the geometrical characteristics of the semi-finished product, hot-rolling, cold-rolling, hot-extrusion, drawing, forging, spinning.

The most usual method of transformation is passing the material, when it has been reheated, through a drawing press; it is then possible to obtain various different shapes: bars, wires, flats, sections, tubes.

It is desirable to have a high extrusion ratio (>20) in order totally to refine and densify the alloy.

Another method of transformation is hot-forging when solid pieces are needed.

In both cases, the semi-finished product is generally passed over a lathe to bring its outer surface to the form of a cylinder of revolution of precise dimensions.

During conversion of semi-finished products, particularly during cold working, it is generally necessary to carry out one or more intermediate annealing stages followed by temperings in order to enhance the ductility of the alloy and in order to be able to continue working it.

According to the invention, the process annealing is a so-called "flash" annealing, that is to say it comprises a very rapid rise in temperature; this temperature is comprised between 450° C. and a temperature slightly below that of liquidus, for example liquidus temperature less 30° C. This temperature is preferably comprised between 650° and 850° C. By the term "very rapid rise", we understand a rate of rise which may be as much as 50° C. per minute for semi-finished products of larger cross-section which are in course of conversion, to 500° C. per second for smaller cross-section semi-finished products such as wires of small cross-section. The practical means of carrying out this flash annealing according to the invention are either known per se or are adaptable from known means. They are often distinguished by a first important parameter which is the continuous/discontinuous nature of the process; "flash" annealing is preferably obtained by a continuous process in contrast to the discontinuous or intermittent "batch" method, the semi-finished product itself being capable of being either continuous (strip) or intermittent (plate, panel).

The second important parameter is the actual heating technique: the calories may be supplied by a source external to the semi-finished product, by radiation, convection or conduction; this group of techniques is referred to as "indirect heating" and is represented by electric resistance furnaces, radiated gas furnaces or furnaces where the flame acts directly on the product to be treated, salt bath or fluidised bed furnaces. In a second group of techniques, the heat is generated within the semi-finished product itself while it is being processed, by techniques referred to as "direct heating" techniques such as heating by Joules' effect or by induction.

It is these latter methods which make it possible to obtain the highest rates of temperature rise. An example of flash annealing in the case where the semi-finished product is of wire form is provided by French Patents Nos. 2288152 and 2519025.

Annealing is always followed by rapid tempering, accomplished by known means; indeed, if the rate of cooling were to be too slow, there might be an onset of hardening by spinodal decomposition, which would be undesirable at this stage.

After final forming which might be different from the previously mentioned methods of shaping, the product obtained is subjected to a heat annealing treatment at mean temperature of between 200° and 400° C. which ensures hardening by spinodal decomposition.

As already mentioned, spinodal decomposition is influenced by the local tin content so that in order to obtain finished products of homogeneous hardness and more generally homogeneous mechanical characteristics, it is essential to preserve an homogeneous distribution of tin until the final annealing phase. The means employed in the invention make it possible to retain both the tin and the lead in their finely dispersed state. Thus, the invention makes it possible to obtain on an industrial and economic scale machinable products of Cu Ni Sn of high and homogeneous hardness.

The method perfected by the Applicants may likewise be applied to other copper alloys. It is most important to obtain copper alloys which exhibit no segregation, particularly in the case of alloys which have a wide solidification interval such as bronzes and particularly those based on Cu and Sn.

The following Examples illustrate the invention without in any way limiting it.

EXAMPLES

EXAMPLE 1

158 kg electrolytic copper and 31 kg electrolytic nickel were placed in a cold crucible; they were then melted under cover of charcoal up to 1295° C.; then, with a graphite cloche, 16.5 kg tin were introduced; after waiting 20 minutes and reaching a temperature of 1190° C., the bath was deoxidised with 2.850 kg CuTi mother alloy followed by a 10 minutes wait prior to the first analysis of the bath. This having shown 0.35% titanium, there was no supplementary addition and spray-deposition of the molten bath was carried out after the temperature had been raised again to 1385° C. to achieve good fluidity.

By conducting spray-deposition on a circular steel plate of 160 mm diameter, and after separation from the steel plate, a billet was obtained weighing 137 kg with an average diameter of 150 mm and 855 mm long.

This billet, cut into two pieces, was regularised in diameter by being turned to a diameter of 145 mm, reheated in an induction furnace for 10.5 minutes to 990° C. and extruded on a press of 1850 tons thrust into a container heated to 500° C. at a speed of 32 m/minute, producing a bar 18 mm diameter with an extrusion ratio of 87, tempered in water from the moment of emergence from the die.

The composition of this billet was:

| | | |
|---|---|---|
| Cu = 76.89% | Ni = 14.90% | Sn = 8.2% by weight |

An 18 mm diameter bar was drawn out to a diameter of 8 mm on a 20-ton straight bench.

It was annealed at 825° C. for 15 minutes and, on leaving the furnace, hardened in water at 20° C.

It was then drawn out again to a final diameter of 3.81 mm.

After a final annealing stage at 825° C. for 15 minutes followed by tempering in water and double pickling: first of all in an acid ferric chloride bath and then in a sulphur chromic bath, its characteristics in the annealed condition were measured and after a spinodal decomposition annealing on this annealed state. The results obtained are set out in the following table:

| STATE | | ANNEALING | SPINODAL ANNEALING |
|---|---|---|---|
| MECHANICAL | R MPa | 548 | 911 |
| CHARACTER- | R MPa | 214 | 559 |
| ISTICS | A % | 37 | 5 |
| | HV | 118 | 256 |
| Mean grain size | μm | 50 | — |

Thus, the bar is suitable for the manufacture of connectors.

EXAMPLE 2

From another liquid bath prepared under the same conditions as in Example 1 spray-deposition was carried out on a copper plate with a surface area of 300×600 mm, 25 mm thick, to obtain a thickness of 30 mm of Cu Ni Sn based alloy. The resultant block was milled on its alloy surface to reduce the thickness to 25 mm.

This pure copper—Cu15Ni8Sn alloy composite material where the junction between the two materials is very strong, was reinforced to 945° C. in a static furnace and rolled in 6 successive passes from 50 to 15 mm. The temperature at the final pass was still 450° C. and the plate obtained was sprinkled violently with water to temper it and avoid its structural hardening.

The plate was then cold-rolled to a thickness of 1 mm. The resultant product is therefore a composite of 0.5 mm of copper intimately bonded to 0.5 mm of Cu15-Ni8Sn.

After being cut to strips 25.4 mm wide, the product was used for making connectors in which the electric current is conducted through the copper while the elasticity and the resistance to relaxation of stresses is ensured by the alloy Cu15Ni8Sn.

Such an association of properties is novel in connection technology and offers considerable practical interest.

We claim:

1. A method of manufacturing a finished product which comprising a copper nickel and tin based alloy and which has undergone spinodal decomposition, comprising the steps of:

a) preparing an alloy melt of the Cu Ni Sn based alloy which contains also titanium or any other decarburising and refining element and optionally lead;

b) forming a semi-finished product by spray-deposition of the alloy melt onto a backing which serves as a support;

c) transforming the semi-finished product, a part of which may be constituted by the said backing, by an annealing stage followed by rapid tempering;

d) subjecting the transformed semi-finished product to a heat annealing treatment in order to effect spinodal decomposition of the part of the product which is constituted by the Cu Ni Sn based alloy to obtain a finished product.

2. A method according to claim 1 in which the alloy has the following composition by weight:

| | |
|---|---|
| Ni | from 0.5 to 35% |
| Sn | from 3 to 13% |
| Ti | from 0.005 to 0.5% |
| Pb | up to 0.5% |
| Impurities | up to 0.5% |

-continued

| | |
|---|---|
| Cu | balance |

3. A method according to claim 2 in which the proportion of Ni by weight is preferably between 8 and 16% while that of Sn is preferably between 4 and 10%.

4. A method according to any one of claims 1 to 3 in which the Ti is introduced into the alloy melt in the form of recycled metal based on Ti associated with Nb or Ni or Fe or Mn, alone or in mixture, the content of the sum of elements Nb, Ni, Fe or Mn in the alloy being less than 0.5%.

5. A method according to any one of claims 1 to 3 in which the titanium in the alloy melt is dispensed at a measured rate, its final content in the alloy melt being adjusted by the addition of CuTi mother alloy.

6. A method according to any one of claims 1 to 3 in which the semi-finished product obtained by spray-deposition is a billet, a tube, a plate, a slab, a strip, which is separated from the said backing prior to transformation of the semi-finished product into an end product.

7. A method according to any one of claims 1 to 3 in which the semi-finished product obtained by spray-deposition is a multi-layer composite comprising a layer of Cu Ni Sn based alloy rigid with a layer of the said backing, the said multi-layer composite then being transformed into an end product.

8. A method according to claim 6 in which the semi-finished product in course of being transformed is subjected to one or a plurality of flash annealing stages followed by tempering in order to obtain a fine grain.

9. A method according to claim 8 in which the rate of annealing temperature rise is greater than 50° C. per minute and in which cooling is obtained by rapid tempering.

10. A method according to claim 7 in which the semi-finished product in the course of being transformed is subjected to one or a plurality of flash annealing stages followed by tempering in order to obtain a fine grain.

11. A method according to claim 10 in which the rate of annealing temperature rise is greater than 50° C. per minute and in which cooling is obtained by rapid tempering.

* * * * *